US007308816B2

(12) United States Patent
Chang

(10) Patent No.: US 7,308,816 B2
(45) Date of Patent: Dec. 18, 2007

(54) FORMING MACHINE HAVING TRANSMISSION MECHANISMS

(75) Inventor: Yun-Te Chang, Tainan (TW)

(73) Assignee: FWU Kuang Enterprises Co., Ltd., Tainan Hsien (TW)

( * ) Notice: Subject to any disclaimer, the term of this patent is extended or adjusted under 35 U.S.C. 154(b) by 0 days.

(21) Appl. No.: 11/180,065

(22) Filed: Jul. 12, 2005

(65) Prior Publication Data

US 2006/0137421 A1 Jun. 29, 2006

(30) Foreign Application Priority Data

Dec. 28, 2004 (CN) ..... 2004 1 0104506

(51) Int. Cl.
*B21D 43/28* (2006.01)

(52) U.S. Cl. ..... 72/421; 470/176; 470/177; 83/222

(58) Field of Classification Search ..... 72/339, 72/421; 83/436.3, 203, 436.5, 267, 222, 83/225–233; 74/25; 470/109, 95, 154, 156, 470/176, 177; 226/180, 156
See application file for complete search history.

(56) References Cited

U.S. PATENT DOCUMENTS 1,261,084 A * 4/1918 Wilcox ..... 72/346
1,305,329 A * 6/1919 Wilcox ..... 470/177
3,200,423 A * 8/1965 Byam et al. ..... 470/29
3,477,075 A * 11/1969 Putetti ..... 470/8
3,903,556 A * 9/1975 Lee ..... 470/89
4,136,417 A * 1/1979 Dahmen et al. ..... 470/31
4,342,127 A * 8/1982 Weaver ..... 470/133

* cited by examiner

*Primary Examiner*—Daniel C Crane
(74) *Attorney, Agent, or Firm*—Christensen O'Connor Johnson Kindness PLLC

(57) ABSTRACT

A forming machine includes a first transmission mechanism connected to a cutting mechanism and a conveying clamp mechanism, a drive mechanism for driving the first transmission mechanism; and a second transmission mechanism driven by the drive mechanism for driving a feeding mechanism. The second transmission mechanism includes a driven wheel driven by the drive mechanism, a first swing member connected to the feeding mechanism and confronting the driven wheel, an eccentric pin projecting axially from the driven wheel and connected slidably to the first swing member. The eccentric pin slides relative to the first swing member while rotating along with the driven wheel so that the first swing member is swung to and fro in a cycle motion and completes one cycle for each revolution of the eccentric pin.

4 Claims, 6 Drawing Sheets

FORMING MACHINE HAVING TRANSMISSION MECHANISMS

CROSS-REFERENCE TO RELATED APPLICATION

This application claims priority from Chinese Patent Appln. No. 200410104506.3 filed on Dec. 28, 2004.

BACKGROUND OF THE INVENTION

1. Field of the Invention

This invention relates to a forming machine, more particularly to a forming machine for producing forged products.

2. Description of the Related Art

A forming machine for producing forged products typically includes a feeding mechanism for feeding a wire material to a cutting mechanism for cutting the wire material into wire sections which are delivered to a die assembly through a conveying clamp mechanism. The forming machine further includes a drive mechanism which drives the cutting mechanism and the conveying clamp mechanism through a first transmission mechanism and which also drives the feeding mechanism through a second transmission mechanism.

The first transmission mechanism includes a cam mechanism which has cam plates to cam respectively the cutting mechanism and the conveying clamp mechanism so that the cutting mechanism and the conveying clamp mechanism are actuated intermittently to perform their respective cutting and delivering actions. The second transmission mechanism includes a driven gear driven by a drive gear of the drive mechanism, and a link connected to and reciprocated by the driven gear. The feeding mechanism is driven by the link and advances the wire material in an intermittent manner.

The intermittent advancement of the wire material by the feeding mechanism are arranged to alternate with the cutting action of the cutting mechanism and the delivering action of the conveying clamp mechanism. To advance intermittently the wire material, the link of the second transmission mechanism is moved forward and backward by the driven gear. When the driven gear rotates by 180 degrees, the link moves forward to actuate the feeding mechanism so that the wire material is advanced. As the feeding mechanism is actuated, the cutting mechanism and the conveying clamp mechanism are temporarily stopped from proceeding with the cutting action and the forwarding action, respectively. When the driven gear rotates further by 180 degrees, the link moves backward so that the feeding mechanism temporarily stops advancing the wire material. At this time, the cutting mechanism and the conveying clamp mechanism perform the cutting and forwarding actions, respectively. Thus, the frequency ratio of the advancement of the wire material and the cutting and delivering of the cut wire sections is 1:1.

In order to increase the speed of such a forming machine, attempts have been made by increasing the rotating speed of the drive gear and the driven gear. However, this increases the speed of the reciprocation of the cam plates, thereby resulting in increased impacts between each cam plate and one of the cutting mechanism and the conveying clamp mechanism. The increased impact forces tend to produce considerable vibrations in the forming machine, thereby increasing an incidence of damaging the machine components.

SUMMARY OF THE INVENTION

An object of the present invention is to provide a forming machine with improved transmission mechanisms for a feeding mechanism, a cutting mechanism and a conveying clamp mechanism.

According to this invention, a forming machine which includes a die assembly, comprises: a cutting mechanism adapted to cut a feed material; a conveying clamp mechanism adapted to deliver a cut section of the feed material from the cutting mechanism to the die assembly; a feeding mechanism adapted to advance the feed material to the cutting mechanism; a first transmission mechanism connected to the cutting mechanism and the conveying clamp mechanism; a drive mechanism driving the first transmission mechanism; and a second transmission mechanism driven by the drive mechanism for driving the feeding mechanism. The second transmission mechanism includes a driven wheel driven by the drive mechanism, a first swing member connected to the feeding mechanism and confronting the driven wheel, and an eccentric pin projecting axially from the driven wheel and connected slidably to the first swing member. The eccentric pin slides relative to the first swing member while rotating along with the driven wheel so that the first swing member is turned to and fro in a cycle motion and completes one cycle for each revolution of the eccentric pin.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
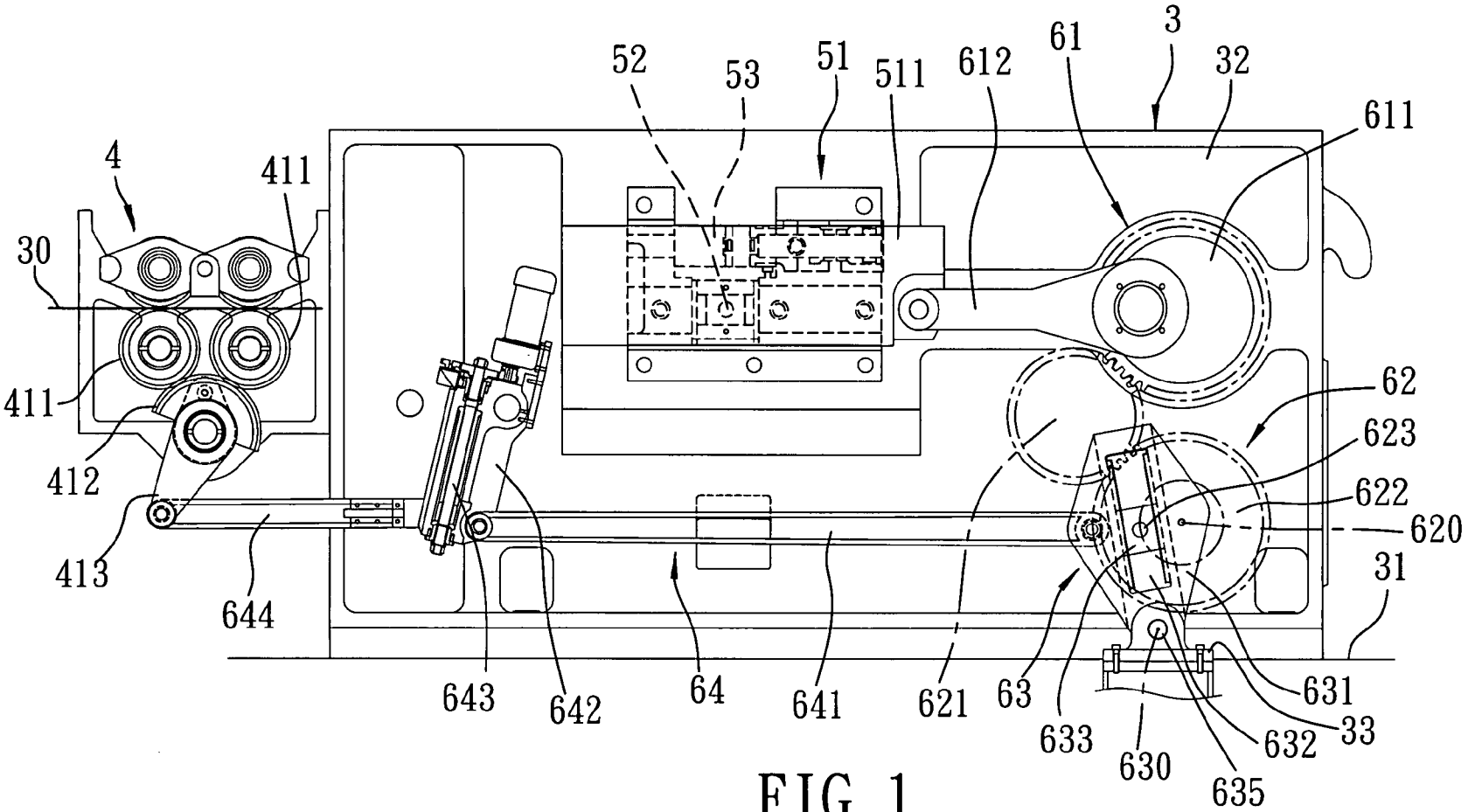
FIG. 1 is a fragmentary elevation view of the first preferred embodiment of the present invention.

Before the present invention is described in greater detail, it should be noted that same reference numerals have been used to denote like elements throughout the specification.

Referring to FIG. 1, a first preferred embodiment of the present invention includes a housing 3, a feeding mechanism 4 disposed at the front of the housing 3. In the housing 3 are provided a drive mechanism 61, a first transmission mechanism 51, a cutting mechanism 52, a conveying clamp mechanism 53, and a second transmission mechanism 62.

The housing 3 includes a base 31 that extends in a front-to-rear direction of the housing 3, a machine body 32 mounted on the base 31 inside the housing 3 for supporting a forging mechanism (not shown) and a die assembly (not shown), and a fixed pivot seat 33 mounted on the base 31 at the left side of the machine body 32.

The feeding mechanism 4 is provided to advance a feed material (e.g. wire) 30 in a front-to-rear direction. The feeding mechanism 4 includes two upper transmission gears 411 intermeshed with two lower transmission gears 411 and a sector-shaped drive gear 412 intermeshed with the lower transmission gears 411. The upper and lower transmission gears 411 are connected coaxially and respectively to four upper and lower feed rollers (not shown) for pinching the feed material 30 therebetween. The wire material 30 is advanced between the upper and lower feed rollers (not shown). Since the constructions of the base 31, the machine body 32, and the feeding mechanism 4 are known, they are not detailed hereinafter.

Figure 2:
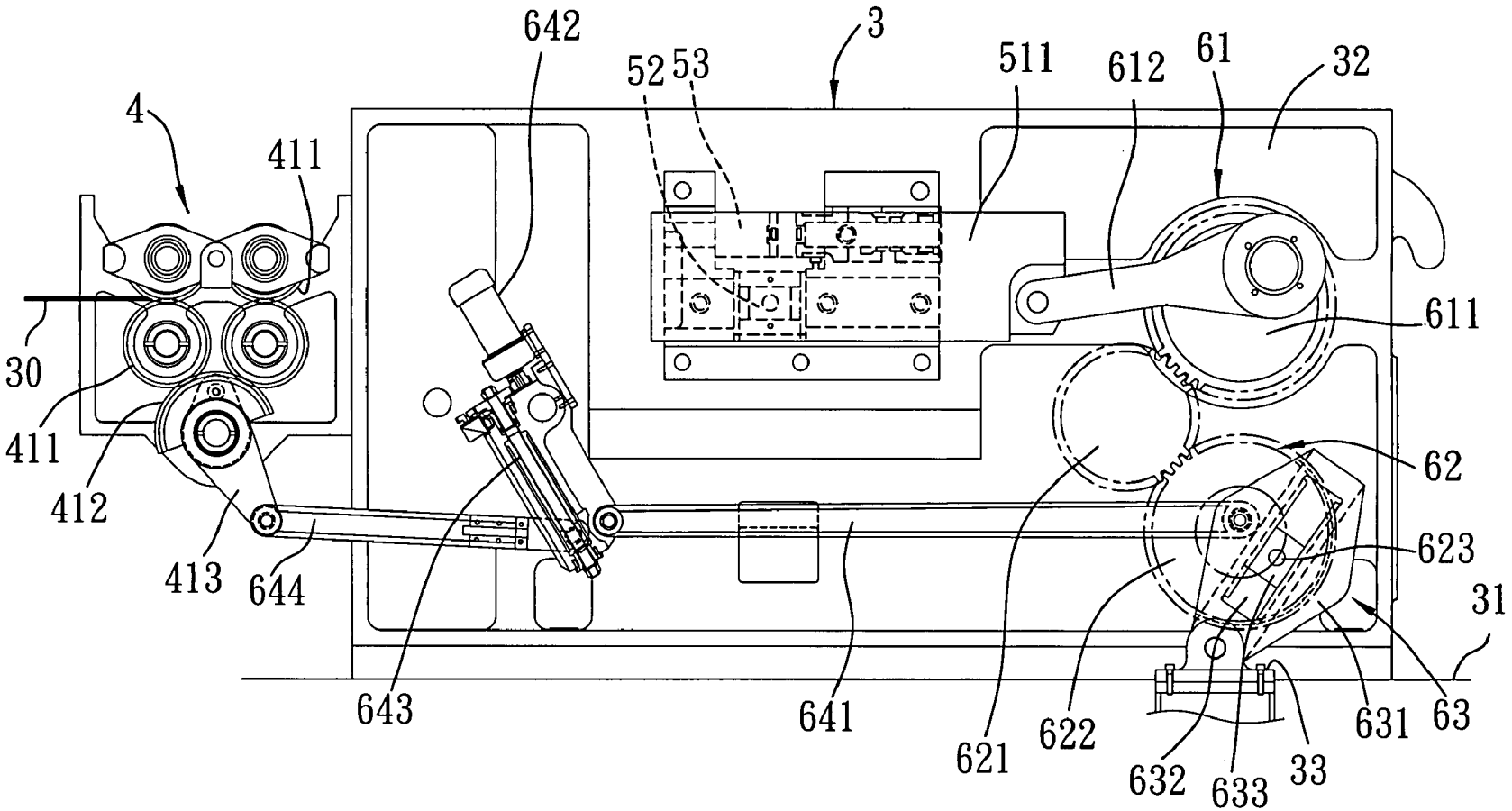
FIG. 2 is the same view as FIG. 1 but with a first swing plate being turned rearward.
Figure 3:
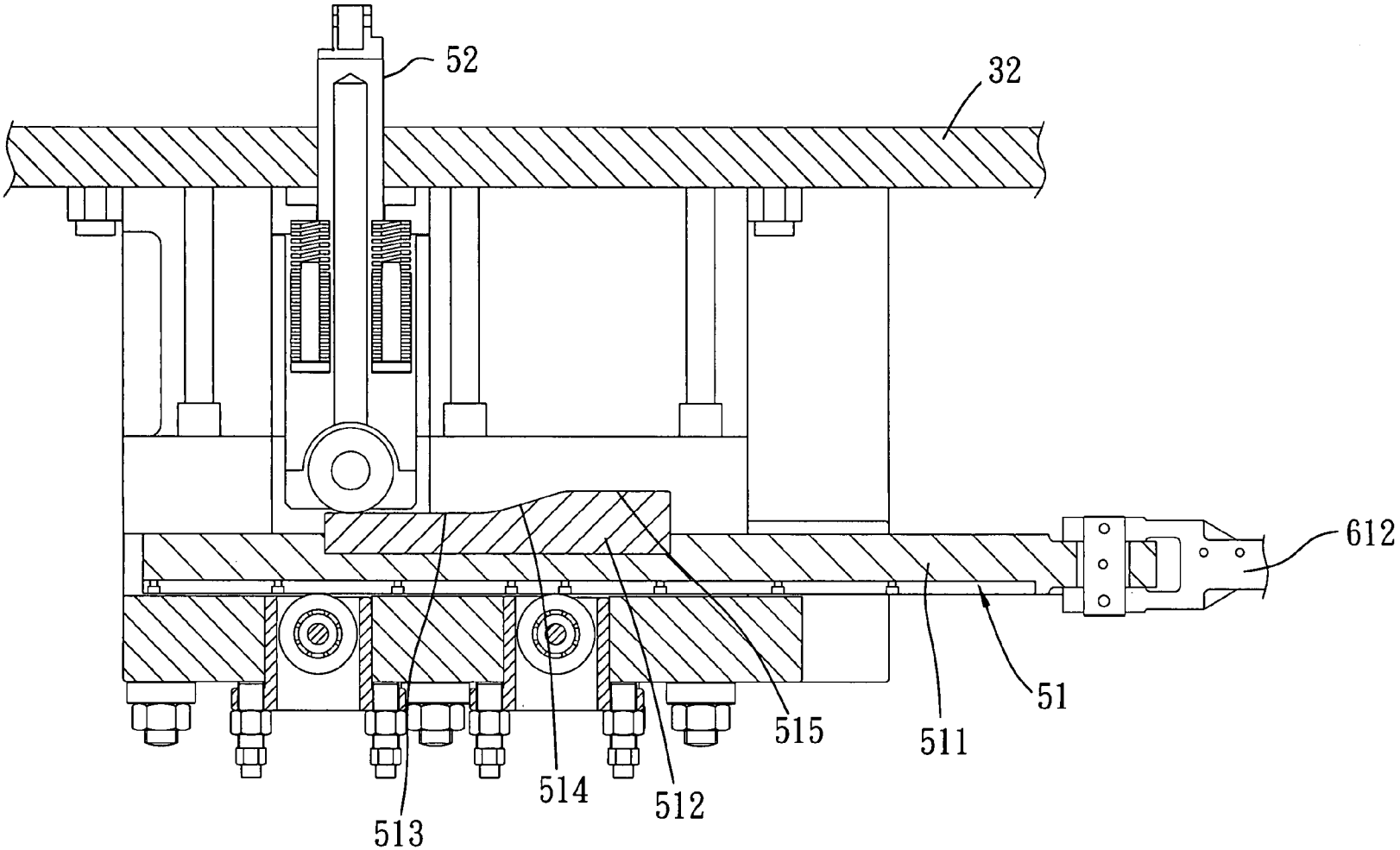
FIG. 3 is a fragmentary plan view of the first preferred embodiment.
Figure 4:
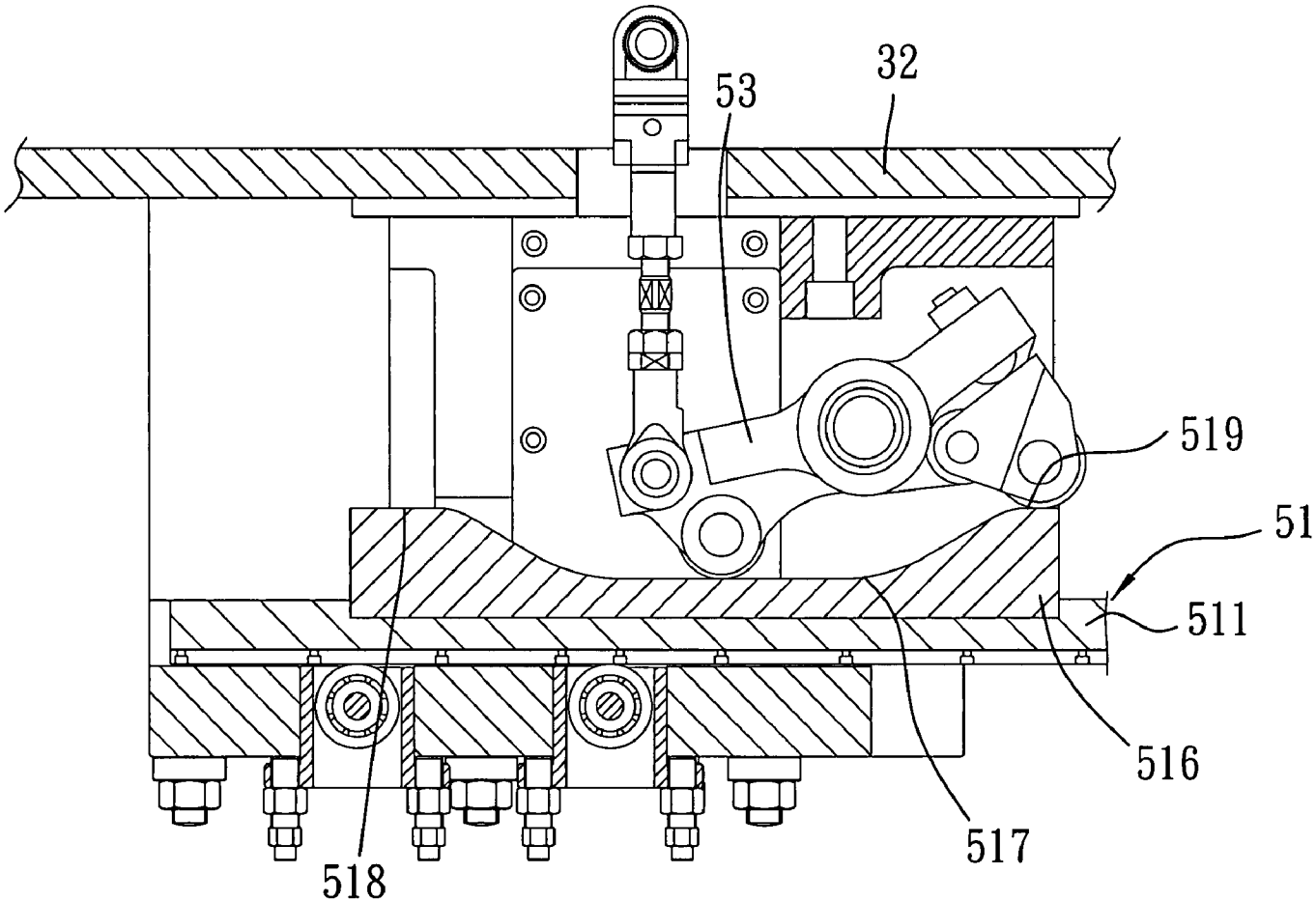
FIG. 4 is another fragmentary plan view of the first preferred embodiment.

Referring to FIGS. 2-4, the cutting mechanism 52 and the conveying clamp mechanism 53 are provided to cut the feed material 30 and to convey and deliver the cut sections of the feed material 30 to a next processing station, i.e. a die assembly (not shown) The cutting mechanism 52 is disposed at a level below the conveying clamp mechanism 53. The first transmission mechanism 51 is a cam mechanism which has a substantially vertical slide plate 511 that is mounted slidably on the machine body 32 in the front-to-rear direction, a first cam plate 512 mounted on the slide plate 511 and confronting the cutting mechanism 52, and a second cam plate 516 mounted on the slide plate 511 above the first cam plate 512 and confronting the conveying clamp mechanism 53. The first and second cam plates 512 and 516 are used to actuate the cutting mechanism 52 and the conveying clamp mechanism 53, respectively.

The first cam plate 512 has a first flat face section 513, a second flat face section 515, and a first inclined surface 514 between the first and second flat face sections 513 and 515. The second cam plate 516 includes an indented part defining a second inclined surface 517, and third and fourth flat face sections 518, 519 formed respectively on two sides of the second inclined surfaces 517. Since the constructions of the first transmission mechanism 51, the cutting mechanism 52 and the conveying clamp mechanism 53 are known in the art, the details thereof are omitted herein for the sake of simplicity.

Figure 5:
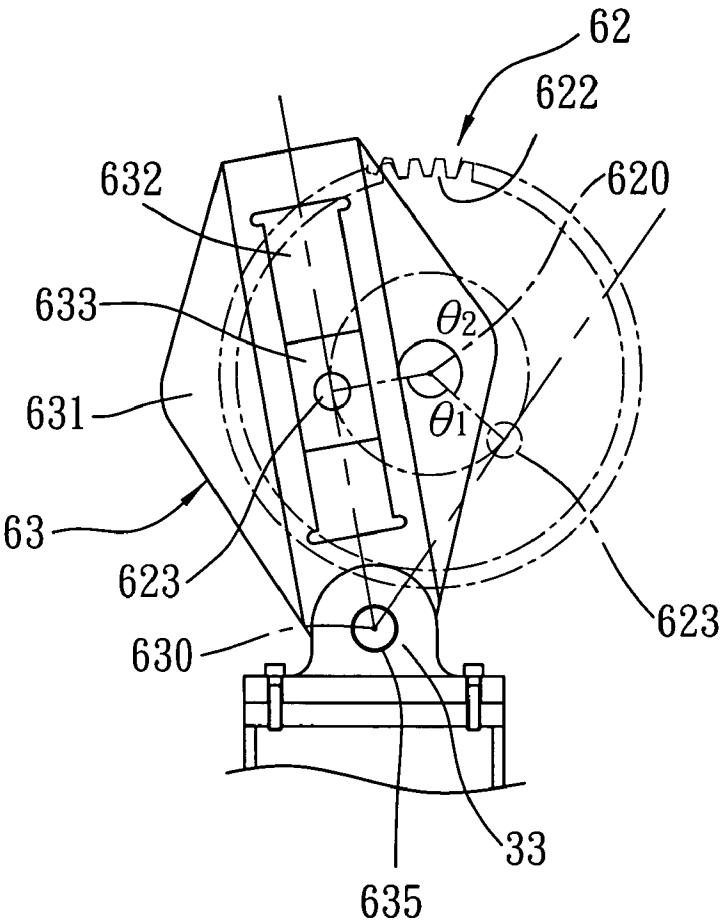
FIG. 5 is a fragmentary view showing the first swing plate and a driven gear of the first preferred embodiment.

Referring to FIG. 5 in combination with FIGS. 1 and 2, the drive mechanism 61 includes a drive gear 611 driven by a power unit (not shown), and a crank 612 which includes a front end connected to the vertical slide plate 511 of the first transmission mechanism 51 and a rear end pivoted eccentrically to the drive gear 611 so that the crank 612 is driven by the drive gear 611 and reciprocates the slide plate 511.

The second transmission mechanism 62 includes a reverse gear 621 meshed with the drive gear 611, a driven wheel in the form of a driven gear 622 meshed with the reverse gear 621, an eccentric pin 623 eccentrically connected to the driven gear 622, a first swing member 63 connected to the eccentric pin 623, and a reciprocating unit 64 connected to the first swing member 63.

The reciprocating unit 64 includes a first connecting rod 641 connected to the first swing member 63, a length adjustment unit 642 mounted movably on the machine body 32 and connected to the first connecting rod 641, and a second connecting rod 644 connected to the length adjustment unit 642. The length adjustment unit 642 has an elongated adjustment hole 643. A connecting end of the second connecting rod 644 is connected slidably to the adjustment hole 643. A front end of the second connecting rod 644 is connected to a second swing member 413. The second swing member 413 is disposed coaxially with the sector-shaped drive wheel 412 for synchronous movement. The position of the connecting end of the second connecting rod 644 in the adjustment hole 643 may be changed to adjust the total length of the reciprocating unit 64 (the sum of the lengths of the first and second connecting rods 641, 644 plus the length of a portion of the length adjustment unit 642). As such, the turning angle of the second swing member 413 may be changed to adjust the length of the feed material 30 to be advanced by the feeding mechanism 4.

When a lower end of the length adjustment 642 is turned rearward by the first connecting rod 641, the sector-shaped drive wheel 412 is rotated counterclockwise so that the feed rollers (not shown) connected to the transmission gears 411 rotate and advance the feed material 30.

The first swing member 63 includes an elongated swing plate 631 with a bottom end which is pivoted to the pivot seat 33 to turn about a pivot axis 635. The pivot axis 635 is substantially parallel to the axis of the driven gear 623, and the swing plate 631 is confronting the driven gear 623. An elongated through hole 632 is formed in the swing plate 631, and a slide block 633 is mounted within the through hole 632 to slide along the length of the through hole 632. The eccentric pin 623 of the driven gear 622 is connected pivotally to the slide block 633. The first connecting rod 641 is connected pivotally to the swing plate 631.

In operation, when the drive gear 611 of the first transmission mechanism 61 is rotated counterclockwise, the crank 612 moves the slide plate 511 forward so that the cutting mechanism 52 and the conveying clamp mechanism 53 are actuated. Simultaneously, the reverse gear 621 is moved clockwise, and the driven gear 622 is turned counterclockwise. In addition, the eccentric pin 623 rotates around the axis 620 of the driven gear 622 and moves the slide block 633. The slide block 633 is therefore slid within the through hole 632 of the swing plate 631. As the slide block 633 is moved, the swing plate 631 of the first swing member 63 is turned forward to a first position as shown in FIG. 4 and rearward to a second position as shown in FIG. 5.

Since the first swing member 63 is turned about the pivot axis 630 arranged below the axis 620 of the driven gear 622 and since the position of the pivot axis 630 of the first swing member 63 is more forward than the axis 620 of the driven gear 622 (i.e. the pivot axis 630 is not aligned with the axis 620 along a vertical line and is located forwardly of the vertical line), the turning angle θ1 of the eccentric pin 623 which rotates counterclockwise and rearward to swing the first swing member 63 from the first position (FIG. 1) to the second position (FIG. 2) is smaller than 180 degrees. When the first swing member 63 is turned rearward to the second position, as shown in FIG. 2, the first swing member 63 pulls the first connecting rod 641 rearward so that the bottom end of the adjustment member 42 is moved rearward. The second swing member 413 therefore rotates the sector-shaped driven gear 412 of the feeding mechanism 4 counterclockwise, thereby actuating the feeding mechanism 4 to advance the feed material 30. At that time, the crank 612 of the first transmission mechanism 61 pulls the slide plate 511 rearward so that the cutting mechanism 52 does not cut the wire material 30, and the conveying clamp mechanism 53 does not deliver the cut sections of the feed material 30.

When the first swing member 63 is turned from the second position to the first position, the eccentric pin 623 rotates counterclockwise by an angle θ2 which is equal to 360 degrees—θ1 and which is greater than 180 degrees. At this time, the feeding mechanism 4 does not advance the feed material 30. However, the first transmission mechanism 51 moves the slide plate 511 forward and actuates the cutting mechanism 52 and the conveying clamp mechanism 53 to cut the feed material 30 and to deliver the cut section of the feed material 30 to the die assembly (not shown), respectively.

As mentioned above, when the eccentric pin 623 rotates along with the driven gear 622, the first swing member 63 is swung by the eccentric pin 623 so that the first swing member 63 moves to and fro in a cycle motion and completes one cycle of the cycle motion for each revolution of the eccentric pin 623. The first swing member 63 executes a first stroke movement (from the first position to the second position of the first swing member 63), and a second stroke movement (the second position to the first position) in one cycle of its cycle motion. The eccentric pin 623 rotates by a first angle θ1 for the first stroke movement of the first swing member 63 and by a second angle θ2 for the second stroke movement. The first angle θ1 is smaller than the second angle θ2.

In this embodiment, θ1 is equal to 140 degrees, whereas θ2 is equal to 220 degrees. Thus, the eccentric pin 623 of the driven gear 622 rotates counterclockwise by an angle of 140 degrees to actuate the feeding mechanism 4 to advance the feed material 30 one time. Since the time taken by the eccentric pin 623 to turn 140 degrees is less than that to turn 220 degrees, the time required by the feeding mechanism 4 to advance the feed material 30 is reduced, compared to the time taken in the course of stopping advancement of the feed material 30. Therefore, the time provided for the cutting mechanism 52 and the conveying clamp mechanism 53 to perform their respective cutting and delivering actions can be increased.

Referring once again to FIGS. 2 to 4, since the time needed to activate the cutting mechanism 52 and the conveying clamp mechanism 53 has been prolonged, the first and second inclined surfaces 514, 517 of the first and second cam plates 512, 516 can be increased in length so that the slope angles thereof can be decreased, thereby reducing the pressure induced on the first and second cam plates 512, 516 during their camming actions. Therefore, when the drive gear 611 is speeded up in order to increase the production rate of the forming machine, vibration movements can be reduced.

Figure 6:
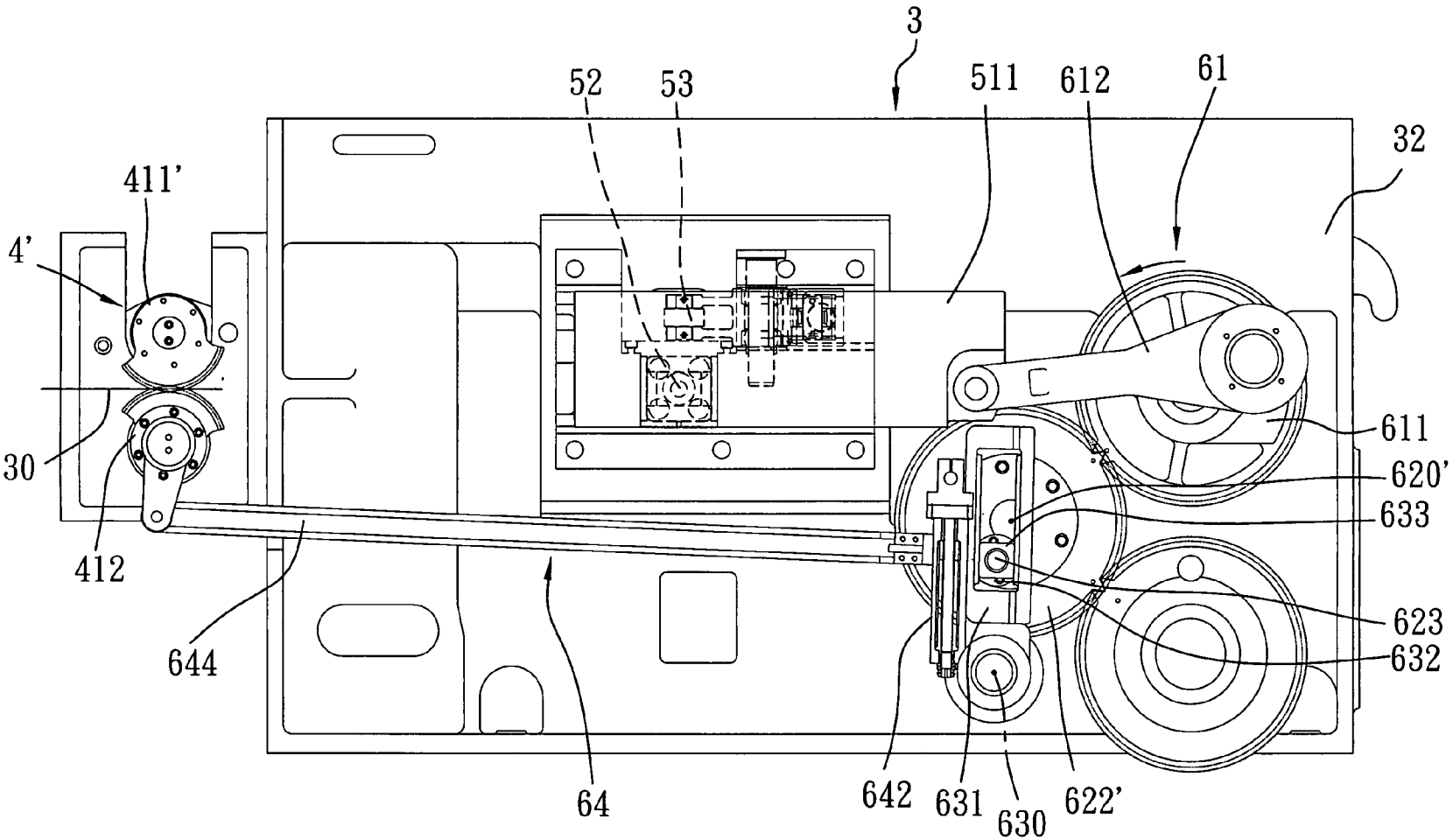
FIG. 6 is a fragmentary elevation view of the second preferred embodiment of the invention.

Referring to FIG. 6, there is shown a second preferred embodiment of the present invention. In the second embodiment, the feeding mechanism 4' includes an upper sector-shaped driven gear 411' and a lower sector-shaped drive gear 412 which are intermeshed each other and which are connected coaxially and respectively to a pair of feed rollers (not shown) to pinch the feed material 30 therebetween for advancement. When the sector-shaped lower gear 412 rotates clockwise, the feed material 30 is advanced to the cutting mechanism 52.

The direction of the sector-shaped drive gear 412 to advance the feed material 30 in this embodiment is opposite to that of the drive gear 412 in the first embodiment. Furthermore, the direction of the driven gear 622' to drive the first swing member 63 is opposite to that of the driven gear 622 in the first embodiment. No reverse gear is provided in this embodiment, and the driven gear 622' is meshed directly with the drive gear 611. Thus, when the drive gear 611 rotates counterclockwise, the driven gear 622' rotates clockwise.

The first swing member 63 includes an elongated swing plate 631. The eccentric pin 623 of the driven gear 622' is connected directly to the slide block 633 in the through hole 632 of the swing plate 631. The swing plate 631 has a bottom end pivoted directly to the left side of the machine body 32. The length adjustment member 642 is fixed directly to a front side of the swing plate 631 so that the length adjustment member 642 is swung synchronously with the swing plate 631.

Therefore, when the driven gear 622' is driven by the drive gear 611 to rotate clockwise, the swing plate 631 turns from the first position to the second position, and the sector-shaped drive gear 412 rotates counterclockwise so that the feed mechanism 4' does not advance the feed material 30. At this time, the cutting mechanism 52 and the conveying clamp mechanism 53 are activated to perform the respective cutting and delivering actions. When the driven gear 622' continues to rotate, the swing plate 631 is turned from the second position to the first position, and the sector-shaped drive gear 412 rotates clockwise so that the feed material 30 is advanced. In this embodiment, the position of the pivot axis 630 of the swing plate 631 is also more forward than the axis 620' of the driven gear 622'.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A forming machine which includes a die assembly, comprising:

a cutting mechanism adapted to cut a feed material;

a conveying clamp mechanism adapted to deliver a cut section of the feed material from said cutting mechanism to the die assembly;

a feeding mechanism adapted to advance the feed material to said cutting mechanism;

a first transmission mechanism connected to said cutting mechanism and said conveying clamp mechanism;

a drive mechanism driving said first transmission mechanism; and a second transmission mechanism driven by said drive mechanism for driving said feeding mechanism, said second transmission mechanism including a driven wheel driven by said drive mechanism, an elongated swing plate connected to said feeding mechanism, confronting said driven wheel, and having an elongated through hole, and an eccentric pin projecting axially from said driven wheel and connected slidably to said elongated through hole in said swing plate, said swing plate having a pivot axis which is substantially parallel to an axis of said driven wheel, said eccentric pin sliding relative to said swing plate while rotating along with said driven wheel so that said swing plate is turned to and fro in a cycle motion and completes one cycle for each revolution of said eccentric pin, wherein said swing plate executes a first stroke movement and a second stroke movement in one cycle, said eccentric pin rotating by a first angle for said first stroke movement and a second angle for said second stroke movement, said first angle being smaller than said second angle, and wherein said driven wheel is a driven gear which is driven by said drive mechanism, said second transmission mechanism further including a reciprocating unit connected to said swing plate and said feeding mechanism.

2. The forming machine as claimed in claim 1, wherein said swing plate further has a slide block slidably disposed in said through hole, said eccentric pin being connected to said slide block.

3. The forming machine as claimed in claim 1, wherein said drive mechanism includes a drive gear to drive said driven gear, and a crank connected to said drive gear and said first transmission mechanism.

4. A forming machine which includes a die assembly, comprising:

a cutting mechanism adapted to cut a feed material;

a conveying clamp mechanism adapted to deliver a cut section of the feed material from said cutting mechanism to the die assembly;

a feeding mechanism adapted to advance the feed material to said cutting mechanism;

a first transmission mechanism connected to said cutting mechanism and said conveying clamp mechanism;

a drive mechanism driving said first transmission mechanism; and a second transmission mechanism driven by said drive mechanism for driving said feeding mechanism, said second transmission mechanism including a driven wheel driven by said drive mechanism, a first swing member connected to said feeding mechanism and confronting said driven wheel, and an eccentric pin projecting axially from said driven wheel and connected slidably to said first swing member, said eccentric pin sliding relative to said first swing member while rotating along with said driven wheel, wherein said first swing member executes a first stroke movement and a second stroke movement, said eccentric pin rotates by a first angle for said first stroke movement and a second angle for said second stroke movement, said first angle is smaller than said second angle, and the sum of said first and second angles is equal to 360 degrees.

* * * * *